US010436548B2

(12) United States Patent
Kronsteiner et al.

(10) Patent No.: US 10,436,548 B2
(45) **Date of Patent: *Oct. 8, 2019**

(54) RECOIL-DAMPING DEVICE

(71) Applicant: Damian Schoenborn, Goellersdorf (AT)

(72) Inventors: Martin Kronsteiner, Vienna (AT); Damian Schoenborn, Vienna (AT)

(73) Assignee: Damian Schoenborn, Goellersdorf (AT)

( * ) Notice: Subject to any disclaimer, the term of this patent is extended or adjusted under 35 U.S.C. 154(b) by 0 days.

This patent is subject to a terminal disclaimer.

(21) Appl. No.: 16/041,228

(22) Filed: Jul. 20, 2018

(65) Prior Publication Data

US 2019/0049212 A1 Feb. 14, 2019

Related U.S. Application Data

(63) Continuation of application No. 15/517,935, filed as application No. PCT/AT2016/060027 on Aug. 10, 2016, now Pat. No. 10,101,116.

(51) Int. Cl.
*F41C 23/06* (2006.01)

(52) U.S. Cl.
CPC ..... *F41C 23/06* (2013.01)

(58) Field of Classification Search
CPC ..... F41C 23/06; F41C 27/22; F41C 23/08
USPC ..... 42/1.06, 74, 72
See application file for complete search history.

(56) References Cited

U.S. PATENT DOCUMENTS 2,731,753 A 1/1956 Mathieu
3,137,958 A 6/1964 Lewis et al.
3,208,179 A 9/1965 Hrebicek
3,405,470 A 10/1968 Wesemann
3,604,138 A 9/1971 Wilson
3,609,902 A 10/1971 Casull
3,685,194 A 8/1972 Coon
3,707,797 A 1/1973 Ruth
(Continued)

FOREIGN PATENT DOCUMENTS

WO 9848235 A1 10/1998
WO 2008030128 A2 3/2008

OTHER PUBLICATIONS

ISA European Patent Office, International Search Report Issued in Application No. PCT/AT2016/060027, dated Oct. 31, 2016, WIPO, 6 pages.

(Continued)

*Primary Examiner* — Joshua E Freeman
(74) *Attorney, Agent, or Firm* — McCoy Russell LLP

(57) ABSTRACT

A recoil-damping device for a gun, in particular for fastening onto or in a buttstock of the gun, having a rear part and a front part which are movable towards one another against the force of at least one damping element. A locking device acting between the rear part and the front part is provided, which in a locking position blocks a relative movement between the rear and front parts and in a release position allows a relative movement between the rear and the front parts. A triggering element which can be activated by means of a shock pulse is further provided, which in a holding position holds the locking device in the locking position and in an active position releases the locking device into the release position. The triggering element and/or at least a part of the locking device is pivotable as a result of the shock pulse.

20 Claims, 7 Drawing Sheets

(56) References Cited

U.S. PATENT DOCUMENTS

| | | | |
|---|---|---|---|
| 3,754,344 | A | 8/1973 | Spiliotis |
| 3,861,273 | A | 1/1975 | Seidel et al. |
| 5,031,348 | A | 7/1991 | Carey |
| 5,447,092 | A | 9/1995 | Dobbins |
| 5,457,901 | A | 10/1995 | Gernstein et al. |
| 5,722,195 | A | 3/1998 | Bentley et al. |
| 5,752,339 | A | 5/1998 | Bentley et al. |
| 5,974,718 | A | 11/1999 | Bentley et al. |
| 6,238,292 | B1 | 5/2001 | Pelkey |
| 6,481,142 | B1 | 11/2002 | McCarthy |
| 7,685,755 | B1 | 3/2010 | Bentley |
| 8,205,371 | B1 | 6/2012 | Cook et al. |
| 8,434,252 | B2 | 5/2013 | Holmberg |
| 8,438,771 | B1 | 5/2013 | Boone |
| 8,448,366 | B2 | 5/2013 | Faifer |
| 9,423,207 | B2 | 8/2016 | Hunkley |
| 2002/0053156 | A1 | 5/2002 | McCarthy |
| 2004/0031182 | A1 | 2/2004 | Bentley |
| 2004/0069138 | A1 | 4/2004 | Jebsen et al. |
| 2006/0096148 | A1 | 5/2006 | Beretta |
| 2008/0178508 | A1 | 7/2008 | Cinciu |
| 2010/0050492 | A1 | 3/2010 | Faifer |
| 2010/0122482 | A1 | 5/2010 | Simms et al. |
| 2010/0170385 | A1 | 7/2010 | Steimke et al. |
| 2010/0229444 | A1 | 9/2010 | Faifer |
| 2010/0251588 | A1 | 10/2010 | Kincel |
| 2010/0275482 | A1 | 11/2010 | Bentley |
| 2010/0281727 | A1 | 11/2010 | Quaedpeerds et al. |
| 2014/0075798 | A1 | 3/2014 | Kincel |
| 2014/0075801 | A1 | 3/2014 | Moretti |
| 2014/0109452 | A1 | 4/2014 | Baker |
| 2016/0010944 | A1 | 1/2016 | Downey et al. |
| 2017/0356717 | A1 | 12/2017 | Pollutro et al. |
| 2018/0017353 | A1 | 1/2018 | Lesenfants |

OTHER PUBLICATIONS

IPEA European Patent Office, English Translation of the International Preliminary Report on Patentability Issued in Application No. PCT/AT2016/060027, dated Feb. 5, 2018, WIPO, 4 pages.

RECOIL-DAMPING DEVICE

CROSS REFERENCE TO RELATED APPLICATIONS

The present application is a continuation of U.S. patent application Ser. No. 15/517,935, entitled "RECOIL-DAMPING DEVICE," filed on Apr. 7, 2017. U.S. patent application Ser. No. 15/517,935 is a U.S. National Phase of International Application No. PCT/AT2016/060027, entitled "RECOIL-DAMPING DEVICE," filed on Aug. 10, 2016. International Application No. PCT/AT2016/060027 claims priority to Austrian Application No. A 50784/2015 filed on Sep. 14, 2015. The entire contents of the above-identified applications are hereby incorporated by reference in their entirety for all purposes.

TECHNICAL FIELD

The invention relates to a recoil-damping device for a gun, in particular for fastening onto or in a buttstock of the gun, optionally a handgun, having a rear part and a front part which are movable towards one another against the force of at least one damping element, wherein a locking device acting between rear part and front part is provided, which in a locking position blocks a relative movement between rear part and front part and in a release position allows a relative movement between rear part and front part, wherein a triggering element which can be activated by means of a shock pulse is provided, which in a holding position holds the locking device in the locking position and in an active position releases the locking device into the release position.

BACKGROUND AND SUMMARY

Devices for damping a recoil acting on a shooter as a result of the firing of a gun are known from the prior art. These devices are configured on the one hand to damp the recoil as effectively as possible in order to avoid or reduce injuries or at least unpleasantness for the shooter and on the other hand to maintain as far as possible a precise target acquisition by the shooter before delivery of a shot and during delivery of a shot sequence. A rigid configuration of the recoil-damping device before delivery of the shot is favorable for the target acquisition.

US 2002/0053156 A1 discloses a gun with a recoil-damping device and a locking device. The locking device allows the effect, in particular a compression, of the recoil-damping device only after an impulse weight accelerated by a shot releases a lock. In this way, an unintentional compression of the recoil-damping device before actuation of the trigger is prevented during aiming at a target. The recoil damping device, which comprises a damping spring and the locking device are arranged between a rear and a front butt part which are displaceable with respect to one another. The locking device comprises ball catches in which balls engage in recesses in a rod connected to the front butt part and a sleeve connected to the rear butt part in order to be able to lock the compression or release from engagement in order to enable compression. A disadvantage of this construction is that the impulse weight in order to release the lock must overcome a frictional resistance produced as a result of its sliding movement so that it is necessary to overcome a relatively high frictional resistance for a reliable triggering of the damping effect.

US 2006/0096148 A1 relates to a system for recoil damping for hunting or sports weapons comprising a locking device which prevents compression of a damping device before triggering of a shot. The locking device and the damping means bringing about the recoil damping, in particular of a hydraulic nature are arranged between a rear butt part of soft material and a front butt part which is displaceable with respect to this. The locking device has slot openings in the rear butt part and resilient latching elements engaging therein in the front butt part. As a result of this type of latching connection, however, a comparatively large shock impulse is disadvantageously required to release the locking connection, with the result that the aim of a recoil damping for the user is only achieved to a certain extent.

It is now the object of the invention to provide a recoil-damping device as specified initially which avoids or at least reduces the disadvantages of the prior art. In particular, the recoil-damping device should ensure a reliable and smooth-running or low-friction triggering of the damping effect also during prolonged use. The device should also be cost-effective to manufacture and simple to maintain and clean.

This object is solved by a recoil-damping device for a gun having a rear part and a front part which are movable towards one another against the force of at least one damping element, wherein a locking device acting between the rear part and the front part is provided, which locking device in a locking position blocks a relative movement between the rear part and the front part and in a release position allows a relative movement between the rear part and the front part, wherein a triggering element which is activated by means of a shock pulse is provided, which is in a holding position holds the locking device in the locking position and in an active position releases the locking device into the release position, wherein that the triggering element and/or at least a part of the locking device is configured to be pivotable as a result of the shock pulse.

According to the invention, the triggering element and/or at least a part of the locking device is configured to be pivotable as a result of the shock pulse. The recoil-damping device has a rear part and a front part which is movable, in particular displaceable with respect to the rear part, wherein a damping element is provided between the rear part and the front part. If the rear part is fastened in a rearward part of the butt and/or the weapon itself which rearward part is located close to the shoulder of a shooter in the usage position of the gun, the front part is integrated in a forward part of the butt which forward part is more remote from the shoulder of a shooter in the usage position of the gun. On the other hand, the recoil-damping device can also be fastened with its front part on the rearward part of the butt of the weapon which rearward part is located close to the shoulder of a shooter in the usage position of the gun so that a gun can easily be retrofitted with the recoil-damping device.

Between the rear part and the front part, the damping element for damping the recoil of the fired gun and a locking device are provided which in a locking position blocks a relative movement between rear part and front part and in a release position allows a relative movement between rear part and front part and therefore the recoil-damping effect. In order to hold the locking device in the locking position during aiming and firing at a target and only allow the locking device to go over into the release position after firing, a triggering element is provided, which is movable between a holding position in which the triggering element holds the locking device in the locking position and an active position in which the triggering element releases the locking device for transfer into the release position. According to the invention, the triggering element and/or at least a part of the locking device is configured to be pivotable here in order to pivot into the release position in a simple manner, as a result of a shock pulse, i.e. in particular as a result of the recoil of the fired gun. Such a configuration of the triggering element and/or a part of the locking device as a pivoting element ensures a reliable, comparatively rapid transition from the holding position into the active position. Since the triggering element and/or at least a part of the locking device are mounted pivotably in a smooth-running manner whilst overcoming only a minimal frictional resistance, a reliable blocking and release of the relative movement between the rear part and the front part is achieved. Optionally the locking device is configured here in the manner of a toggle lever with the result that a stable positioning in the locking position is ensured. However, the occurrence of a comparatively small shock pulse is sufficient in this case to release the locking device from the locking position. Instead of such pivotable components, intermeshing components subject to wear or triggering elements sliding along large-area, possibly contaminated contact surfaces are known from the prior art.

Overall, a device for recoil damping of a gun, in particular a handgun or long gun, is obtained which can be manufactured cost-effectively, which is also reliable in continuous operation and which is easy to maintain.

The terms rear part and rearward describe a position on the recoil-damping device or on the gun which lies closer to the shoulder of a shooter firing the gun than a position described by the terms front part or front, i.e. the muzzle side of the gun.

According to a preferred embodiment of the invention, in the locking position of the locking device the triggering element, in a contact region, is in engagement with the locking device to form a line contact or point contact. In this way, the contact surface or the contact area between the triggering element located in the holding position and the locking device is kept as small as possible so that the triggering element and the locking device can be released from their mutual engagement with a low expenditure of force when the triggering element, resting on the locking device, moves from the holding position into the active position. The terms line contact and point contact naturally comprise extensive contact areas which describe the shape of a line or of a point according to their small dimensions in one or all the directions of extension.

For a particularly smooth-running or low-friction release of the engagement between the triggering element and the locking device, it is favorable if the line contact or point contact is formed by means of at least one, optionally by means of two mutually opposite elements which are mounted rotatably and which are circular about a respective axis of rotation in the circumferential direction.

In a particularly expedient embodiment, it can be provided that the rotatably mounted elements are rollers and/or balls arranged on the triggering element and/or on the locking device. The arrangement of at least one roller or ball is cost-effective and enables a reliable release of the triggering element from the engagement with the locking device. A single rotatably mounted element can thus roll on the respectively opposite triggering element or the respectively opposite locking device without significant frictional resistance. In the preferred case of respectively one rotatably mounted element on the triggering element and on the locking device, each of the rotatably mounted elements rolls on the respectively opposite rotatably mounted element.

A further embodiment can provide that the locking device comprises a receiving element, in particular a recess in the front part/rear part, and a pivot arm mounted on the rear part/front part which engages in the receiving element in the locking position, which pivot arm is in engagement with the triggering element in the locking position. The receiving element is therefore displaceable in relation to the pivot arm in the active position of the triggering element whilst the receiving element holds the pivot arm at a fixed position in the holding position of the triggering element. The receiving element, which can be configured as a recess, indentation, and projection or similar is formed in order to achieve a release of the pivot arm from engagement with the receiving element when the triggering element goes over from the holding position into the active position, in particular due to the shock pulse. Optionally the receiving element has a sloping contact surface for engagement with the pivot arm so that when it is no longer held in the locking position by the triggering element, the pivot arm goes over into the release position as a result of the recoil and the sloping surface which is thereby displaced relative to the pivot arm. The locking device can also be configured in such a manner that the pivot arm is released from engagement with the receiving element by means of gravity when it is no longer held by the triggering element in the locking position.

For a particularly low-friction transition from the locking position into the release position and back, it is favorable if for engagement in the receiving element, in particular the recess, the pivot arm has the rotatably mounted element, in particular the roller or ball, provided for line contact or point contact with the triggering element, optionally on its end facing the receiving element. By means of the rotatably mounted element, the pivot arm can roll on those surfaces with which the pivot arm comes into engagement during the relative movement between rear part and front part, in particular on the receiving element.

In order to avoid an undesired relative movement between rear part and front part before a firing, in particular during aiming at a target, it is advantageous if the triggering element is pre-tensioned into the holding position by means of a first pre-tensioning element. By this means the locking device is then reliably held in the locking position even when the gun is moved according to usual use. The pre-tensioning element can be a spring element. Alternatively to a spring element, the triggering element could be pre-tensioned into the holding position by means of a magnetic device. For this purpose, a first magnetic element could be provided on the triggering element and a second magnetic element having the same or opposite polarity thereto could be provided close to the first magnetic element and externally to the triggering element.

In order that the pivot arm automatically goes back into the locking position again from the release position after recoil damping has taken place, it can be provided that the pivot arm is pre-tensioned into the locking position by means of a second pre-tensioning element. The second pre-tensioning element can, for example, be a spring element or a magnetic device. Alternatively the pivot arm can be returned by the triggering element into the locking position when the triggering element is pre-tensioned into the holding position.

In order that the triggering element moves automatically from the holding position into the active position as a result of the shock pulse, in particular as a result of the recoil caused by the firing, it is favorable if the triggering element is configured to be pivotable about a pivot axis and has different mass above and below the pivot axis. For example, the triggering element can have a higher mass above/below the pivot axis than opposite below/above the pivot axis. In particular, the triggering element can have different mass moments of inertia above and below the pivot axis. As a result of the different masses in relation to a pivoting of the part of the triggering element located above the pivot axis compared to the part of the triggering element located below the pivot axis, the more inert part executes a delayed movement in the recoil direction as a result of the shock pulse with the result that the triggering element pivots about the pivot axis. In particular, the more inert part tends to retain its position directly after a firing in relation to a fixed reference point external to the gun whereas the rest of the gun moves abruptly towards the shooter as a result of the firing. The weight of the triggering element or the part located above and below the pivot axis is favorably selected to be sufficiently large in order to reliably overcome an albeit small frictional resistance counteracting the movement of the triggering element. Expediently the triggering element is mounted with as low friction as possible.

If both the triggering element and also the pivot arm each comprise a rotatably mounted element, in particular a roller or ball and in the holding position of the triggering element, the pivot axis of the triggering element and the two axes of rotation of the rotatably mounted elements are arranged in a line, the pivot arm is reliably held in the locking position when the triggering element is in the holding position. Furthermore, the engagement between the pivot arm and the receiving element can be released with low expenditure of force since the rotatably mounted elements roll on one another as a result of the shock pulse.

According to a further advantageous embodiment, it can be provided that the triggering element is configured as a delay element displaceable substantially in the direction of the relative movement between rear part and front part. The triggering element has a sufficiently high weight so that as a result of the shock pulse directly after a firing, it retains its position in relation to a fixed reference point external to the gun whereas the remainder of the gun, in particular the locking device moves abruptly towards the shooter as a result of the firing. As a result of this displacement between the triggering element and the locking device, the triggering element adopts its active position. The triggering element can be arranged displaceably parallel to the direction of the relative movement between rear part and front part or at an acute angle to this direction.

A particularly low-friction guidance of the movement sequence of the triggering element is ensured if the triggering element is received at least with a partially spherical end region in a guide sleeve pivotably and displaceably. The triggering element can thus be displaced both along the guide sleeve whose axis runs substantially in the direction of the relative movement between rear part and front part and can also pivot about the axis of the guide sleeve. The pivoting movements are made possible by the partially spherical end region or in general an at least partially rounded end region of the triggering element. In particular, the partially spherical end region together with a corresponding counterbody can form a gimbal bearing received displaceably in the guide sleeve. The displaceable and pivotable configuration of the triggering element ensures a reliable engagement with the locking device, in particular the pivot arm and a reliable transfer between the holding position and the active position. In addition, manufacturing tolerances which could result in a jamming of the triggering element in the guide sleeve if no possibility of pivoting is provided can be compensated.

In order to reliably pre-tension the triggering element in the holding position, it is particularly favorable if the first pre-tensioning element is received in the guide sleeve. The first pre-tensioning element can be received, for example, between an end region of the guide sleeve and the partially spherical end region of the triggering element or the gimbal bearing.

In an expedient embodiment, it can be provided that both the triggering element and also the pivot arm each comprise a rotatably mounted element, in particular a roller or ball and the axes of rotation thereof, in the holding position of the triggering element, are arranged in a line with an axis of rotation of an additional rotatably mounted element, in particular a roller or ball, which additional element is in engagement with the rotatably mounted element of the triggering element and is opposite the contact point between the rotatably mounted elements of the triggering element and of the pivot arm. By means of this line arrangement, the pivot arm is reliably held in the locking position when the triggering element is in the holding position. In addition, the engagement between the pivot arm and the receiving element can be released with low expenditure of force, since the triggering element is displaced relative to the locking device as a result of the shock pulse and the rotatably mounted elements of the triggering element, of the pivot arm and of the additional element roll on one another.

For a reliable transition of the triggering element arranged between the rotatably mounted elements of the pivot arm and of the additional element from the holding position into the active position, it is favorable if a limiting device is provided which stops the displacement of the triggering element pre-tensioned by the first pre-tensioning element at the position of the line arrangement of the axes of rotation. A pin limiting the displacement of the triggering element can be provided as the limiting device. Expediently, the (threaded) pin can be configured to be adjustable in its position.

For a low-friction guided relative movement between the rear part and the front part, it can expediently be provided that guide rollers guiding the relative movement between rear part and front part are provided. In this way, no sliding surfaces are required between the rear part and front part which could impair or even block the relative movement for example due to impurities or wear.

In addition, it can be advantageous if the guide rollers are mounted on the rear part/front part and engage in guide grooves or guide rails in or on the front part/rear part. Since the guide rollers are configured as wheels, for example and run along in guide grooves or are configured as rollers with a groove in the circumferential direction in which groove the guide rails engage, the relative movement between the rear part and the front part can be guided particularly precisely.

In order to achieve a damping effect as high as possible, it is expedient if the rear part or the front part has a longitudinally directed indentation running in the direction of the relative movement between rear part and front part, which indentation receives the damping element which with one end acts on the rear part and with the other end acts on the front part. As a result of the arrangement of the damping element in the indentation, the damping element is held securely in its position. The indentation favorably runs parallel or at least at an angle which is as acute as possible to the direction of the relative movement between rear part and front part.

In a particularly simple embodiment, the damping element can be a spring, in particular a helical spring.

BRIEF DESCRIPTION OF THE FIGURES

The invention is explained further hereinafter with reference to preferred exemplary embodiments to which it should not however be restricted. In the drawings.

DETAILED DESCRIPTION

Figure 1:
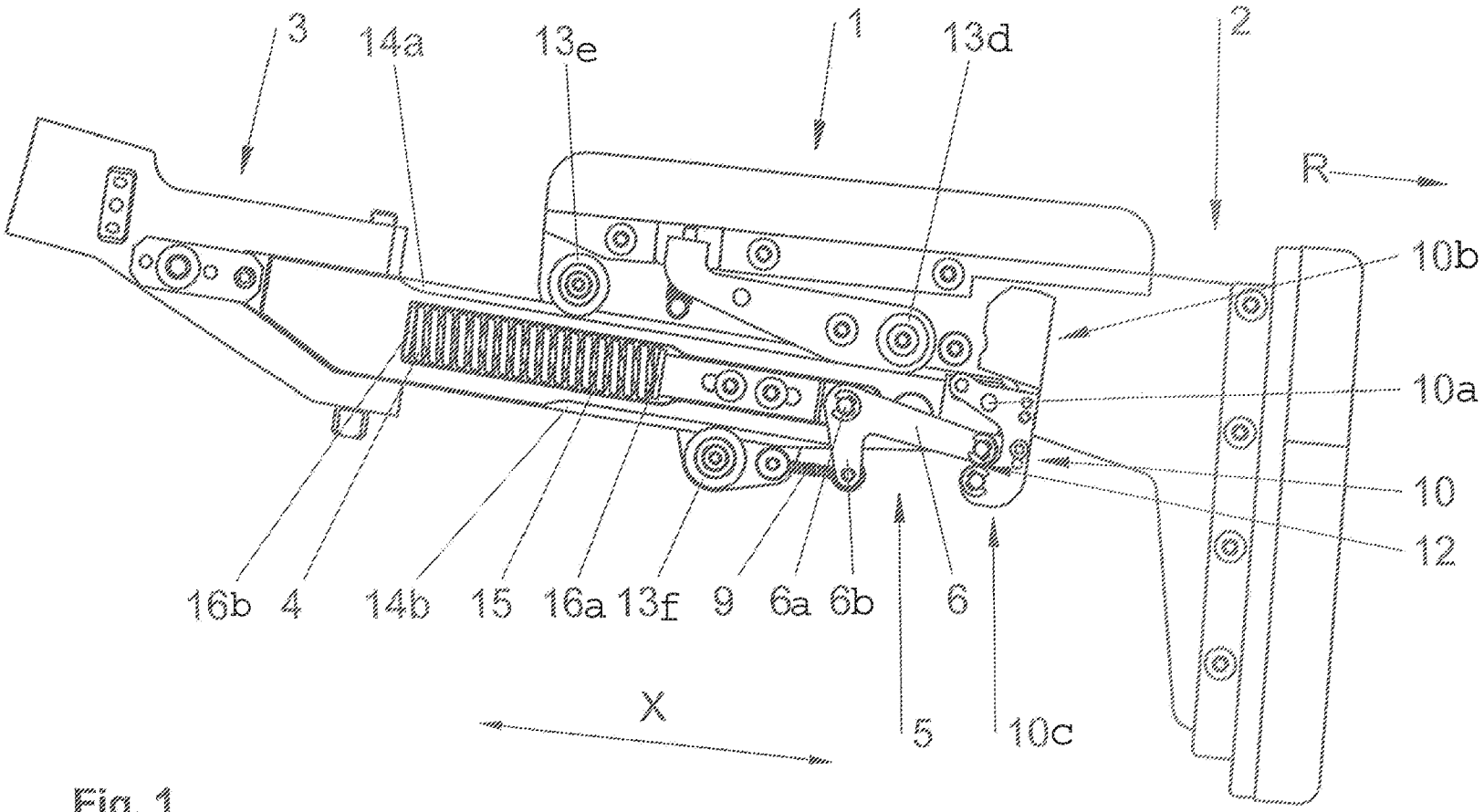
FIG. 1 shows a schematic side view of a first embodiment of the recoil-damping device according to the invention in a rest state.

FIG. 1 shows a recoil-damping device 1 for a gun, for fastening on or in a buttstock of the gun, the buttstock serving as the rest of the gun on the shoulder of a shooter and is not shown. The recoil-damping device 1 comprises a rear part 2 and a front part 3 which are movable against one another against the force of a damping element 4, in the present example a helical spring. The rear part 2 which is more distant to the barrel of the gun than the front part 3, and the front part 3 can be installed in a buttstock of the gun which buttstock consists of parts which can be displaced with respect to/against one another. Alternatively, if e.g. the gun has no buttstock consisting of parts which can be displaced with respect to one another, it can be retrofitted with the recoil-damping device 1 by mounting the front part 3 on the rear-side end of the buttstock. A locking device 5 is provided between the rear part 2 and the front part 3 which locking device 5, in a locking position shown in FIG. 1 blocks a relative movement between rear part 2 and front part 3 and in a release position shown in FIG. 3, allows a relative movement between rear part 2 and front part 3. In the rest state of the gun, as long as no shot is released, the locking device 5 is in the locking position in order to prevent an unintentional compression of the damping element 4. The locking device 5 has an angled substantially L-shaped pivot arm 6 with a pivot axis 6*a* and a receiving element 7, in particular a recess. Whilst the receiving element 7 is formed in or on the front part 3, the pivot arm 6 is mounted by means of the pivot axis 6*a* on the rear part 2 and engages in the receiving element 7 in the locking position. For engagement in the receiving element 7, the pivot arm 6 has on its end 6*b* facing the receiving element 7 an element 8, mounted rotatably and which is circular about its axis of rotation 8*b* in the circumferential direction, in particular a roller or ball 8*a*. At the other end 6*c*, the pivot arm 6 is connected to a second pre-tensioning element 9, for example, a spring, with the result that the pivot arm 6 is pre-tensioned into the locking position. The receiving element 7 has an obliquely running surface or edge 7*a* along which the roller or ball 8*a* of the pivot arm 6 can roll.

Figure 2:
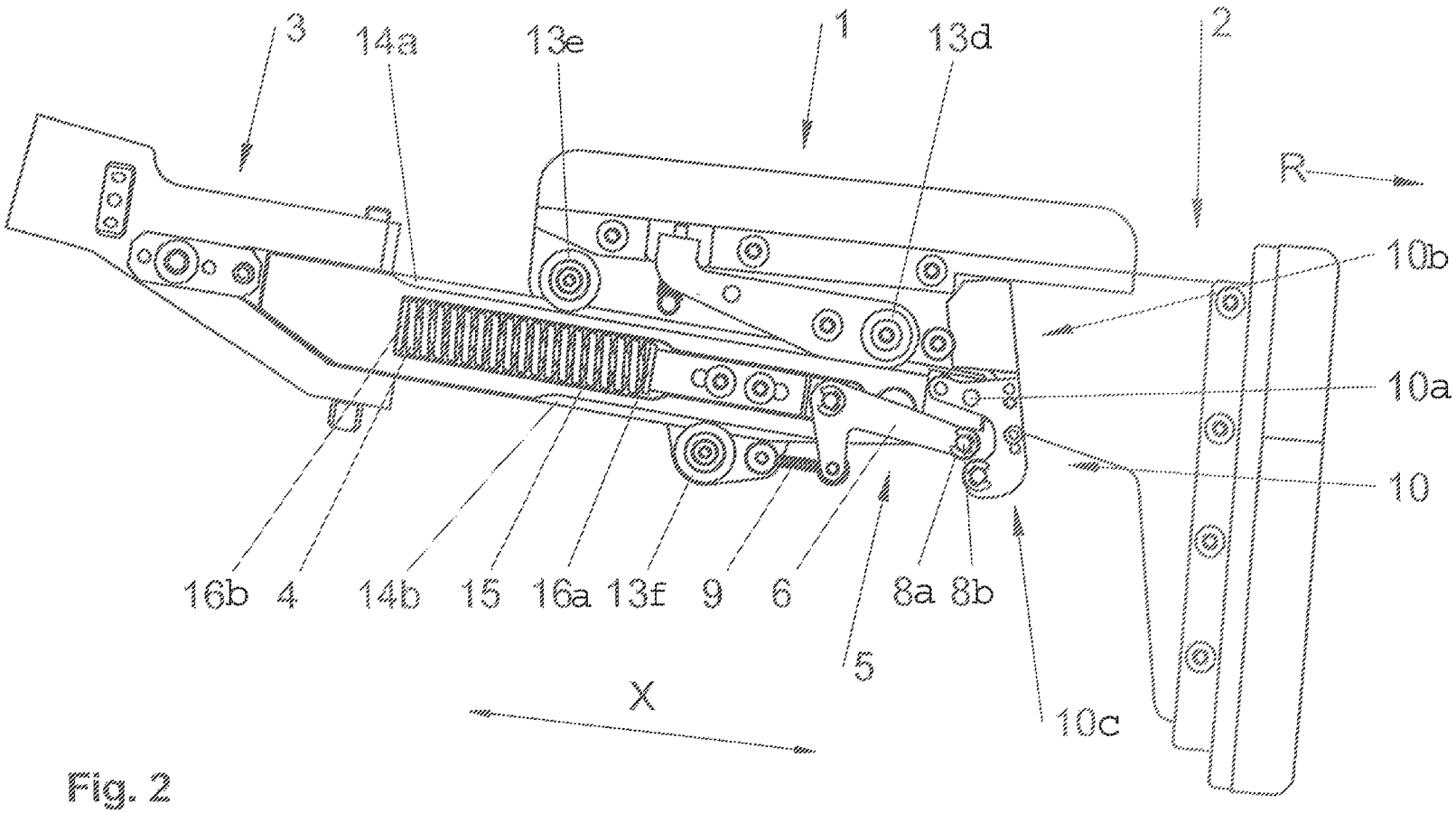
FIG. 2 shows a schematic side view of the first embodiment in a state of transition into a damping process.
Figure 3:
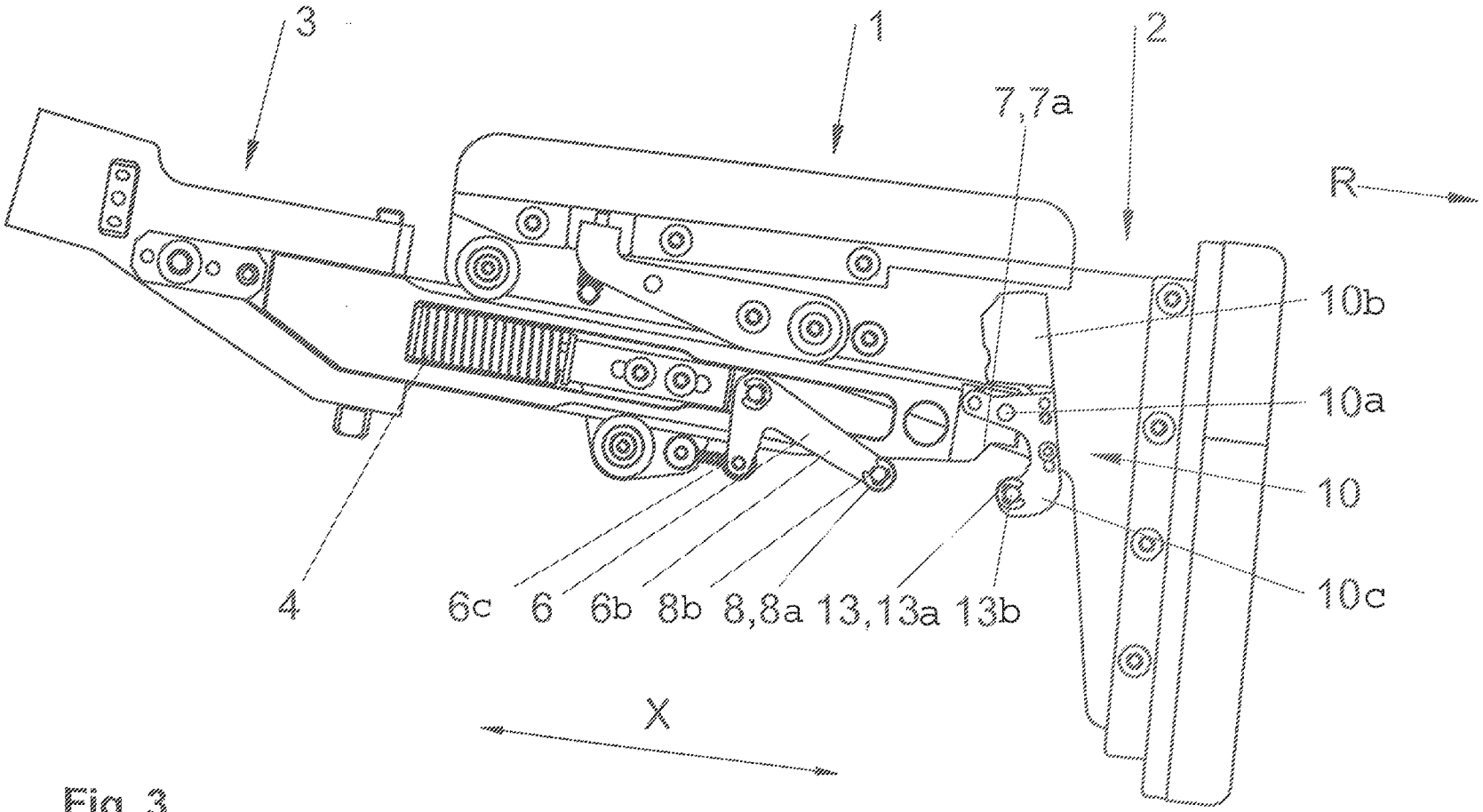
FIG. 3 shows a schematic side view of the first embodiment in a state at the end of the damping process.

In order to be able to release the locking device 5 from the locking position as a result of the firing of a shot, a triggering element 10 which can be activated by means of a shock pulse is provided which in a holding position shown in FIG. 1 holds the locking device 5 in the locking position and in an active position shown in FIGS. 2 and 3 releases the transition of the locking device 5 into the release position. In order to achieve a transition as smooth as possible from the locking position into the release position, both at least a part of the locking device 5, in particular the pivot arm 6 and also the triggering element 10 are configured to be pivotable as a result of the shock pulse triggered by the recoil of the fired gun. The triggering element 10 has a pivot axis 10*a* for this purpose. In order that the triggering element 10 pivots automatically as a result of the shock pulse, it has different mass above and below the pivot axis 10*a*, i.e. the mass center of gravity of the triggering element 10 is arranged either above or below the pivot axis 10*a*. The different mass in relation to a pivoting of the part 10*b* of the triggering element 10 arranged above the pivot axis 10*a* compared to the part 10*c* of the triggering element 10 arranged below the pivot axis 10*a* can be achieved by different weight and/or different shaping of the two parts 10*b*, 10*c*. It is essential that the more inert part, in the exemplary embodiment of FIGS. 1 to 3, the upper part 10*b*, executes a delayed movement in the recoil direction R as a result of the shock pulse with the result that the triggering element 10 pivots about the pivot axis 10*a* into the active position and thereby releases the locking device 5. In order that the triggering element 10 automatically returns into its original holding position after the recoil damping has taken place, the triggering element 10 is pre-tensioned into the holding position by means of a first pre-tensioning element 11, see FIG. 4. For an engagement of the triggering element 10 with the locking device 5, in particular the pivot arm 6, which engagement is produceable and releaseable again in smooth-running way, in the locking position of the locking device 5 the triggering element 10 is in engagement with the locking device 5 in a contact area 12 forming a line contact or point contact. The line contact or point contact is formed by means of an element 13 which is circular about its axis of rotation 13*b* in the circumferential direction and mounted rotatably, in the exemplary embodiment of FIGS. 1 to 4 a roller or ball 13*a*, and by means of the opposite roller or ball 8*a* of the pivot arm 6. In order on the one hand to reliably hold the pivot arm 6 in the locking position by means of the triggering element 10 and on the other hand in order to be able to smoothly release the engagement between the pivot arm 6 and the receiving element 7, in the holding position of the triggering element 10, the pivot axis 10*a* of the triggering element 10 and the two axes of rotation 8*b*, 13*b* of the rollers or balls 8*a*, 13*a* are arranged in a line.

For a low-friction guided relative movement between the rear part 2 and the front part 3 guide rollers 13*d*, 13*e* and 13*f* mounted on the rear part 3 are provided which engage in guide grooves or guide rails 14*a*, 14*b* in or on the front part 3.

As can be additionally seen from FIGS. 1 to 4, the front part 3 has a longitudinally directed indentation or recess 15 running in the direction X of the relative movement between rear part 2 and front part 3, which indentation or recess 15 receives the damping element 4 acting with one end 16*a* on the rear part 2 and with the other end 16*b* on the front part 3. The indentation 15 runs parallel to the direction X of the relative movement.

Figure 4:
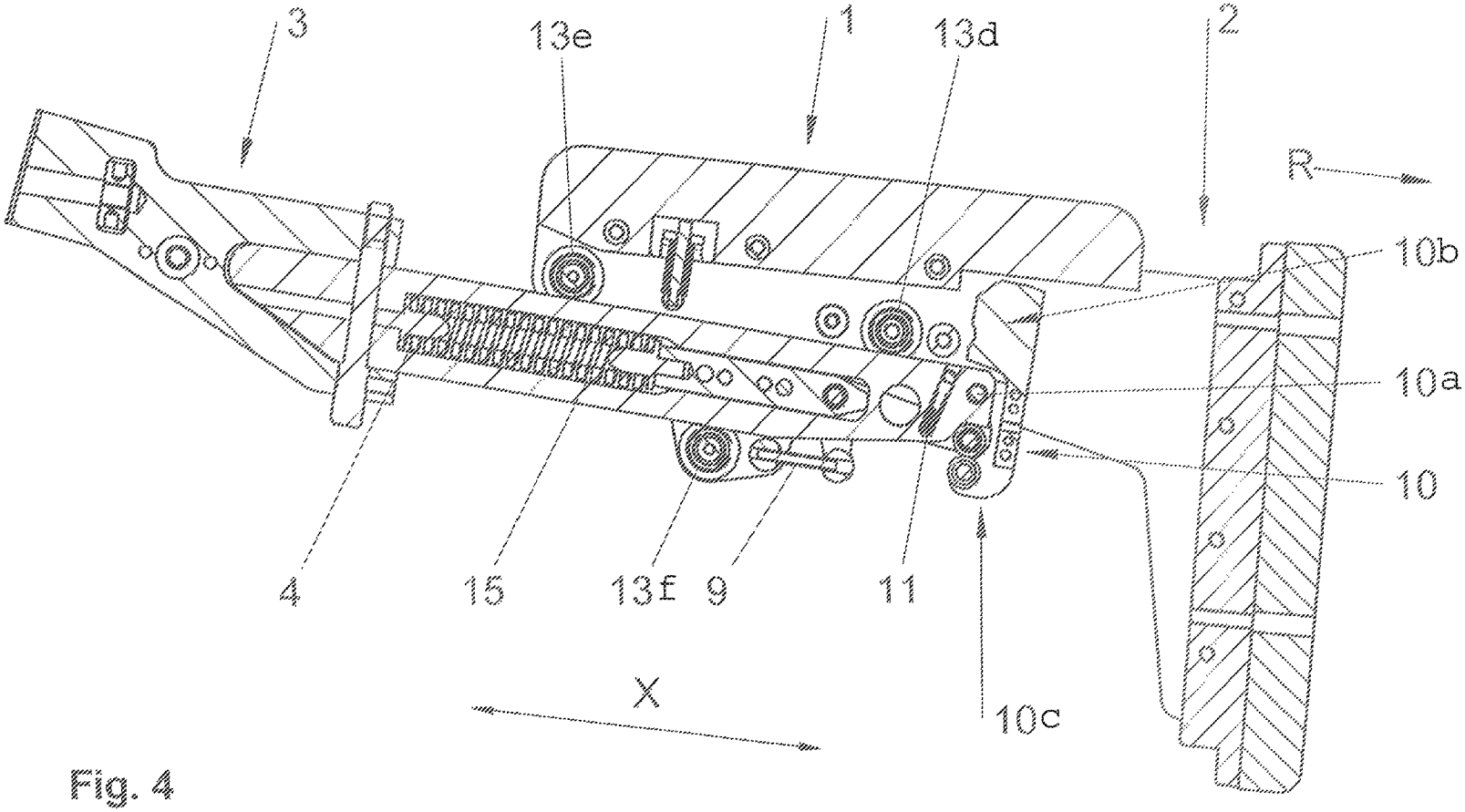
FIG. 4 shows a cutaway side view of the first embodiment in the rest state of the recoil-damping device.

FIGS. 1 and 4 show the recoil-damping device 1 in the rest state in which the locking device 5 is in the locking position and is held in the locking position by the triggering element 10 so that no relative movement takes place between rear part 2 and front part 3.

FIG. 2 shows the recoil-damping device 1 on transition into a damping process as a result of a firing. As a result of the shock pulse in the recoil direction R, caused by the firing, substantially only with the exception of the more inert upper part 10*b* of the triggering element 10, the entire gun is pushed backwards so that the triggering element 10 is pivoted from the holding position into the active position and here rolls on the roller or ball 8*a* of the pivot arm 6. As soon as the upper part 10*b* of the triggering element 10 has pivoted sufficiently in the direction of the front part 3, in order to release the engagement between the triggering element 10 and the pivot arm 6, the transition of the locking device 5 into the release position is released.

FIG. 3 shows the recoil-damping device 1 in a state at the end of the damping process. After the transition of the locking device 5 into the release position has been released by the triggering element 10, the roller or ball 8*a* of the pivot arm 6 rolls on the obliquely running surface or edge 7*a* of the receiving element 7 and the front part 3 is moved towards the rear part 2 supported by the shoulder of the shooter, whereby the damping element 4 is compressed. Thereafter the damping element 4 relaxes again with the result that the front part 3 moves away from the rear part 2 and the pivot arm 6 comes into engagement with the receiving element 7 and the triggering element 10.

Figure 5:
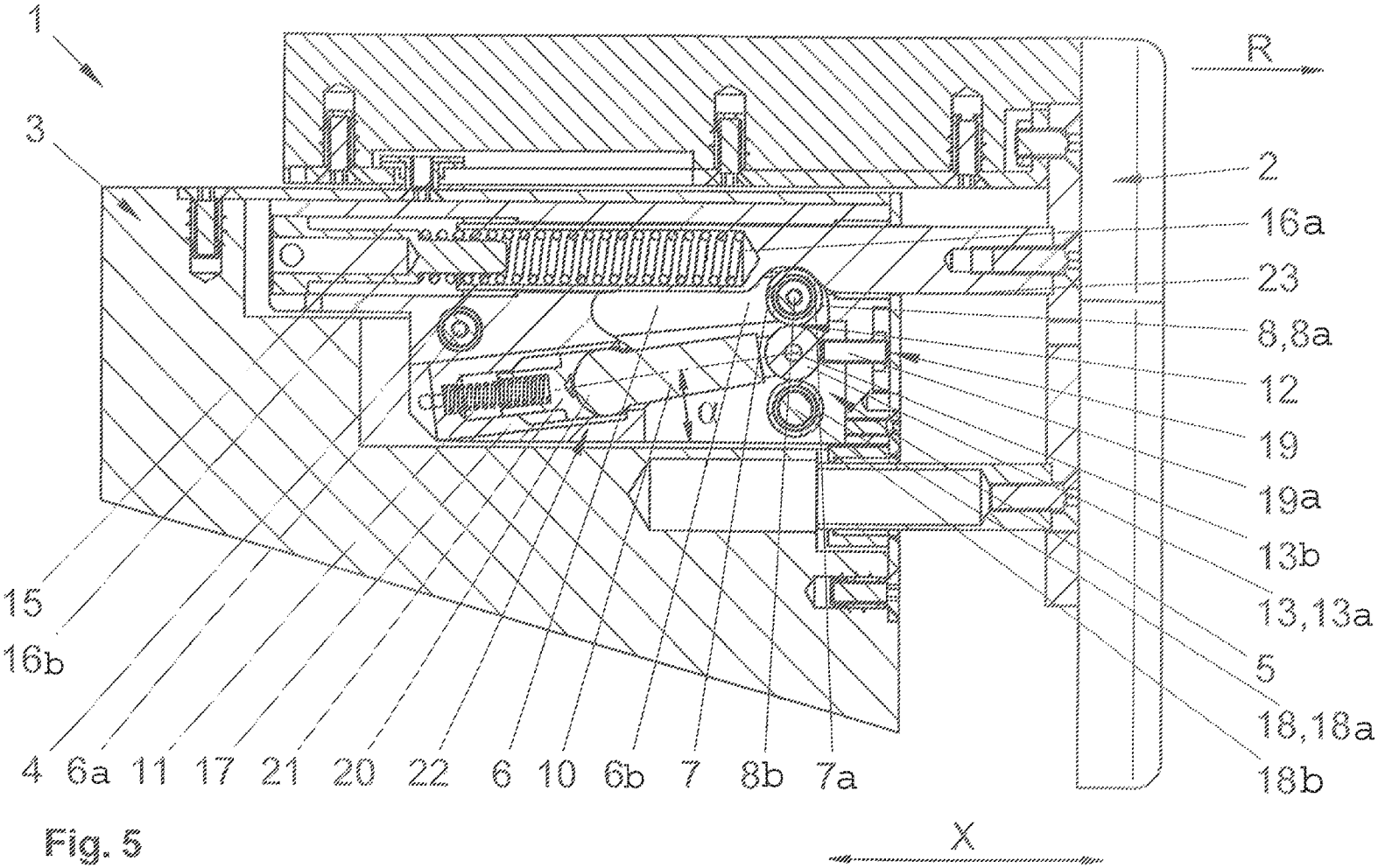
FIG. 5 shows a schematic side view of a second embodiment of the recoil-damping device according to the invention in a rest state.
Figure 6:
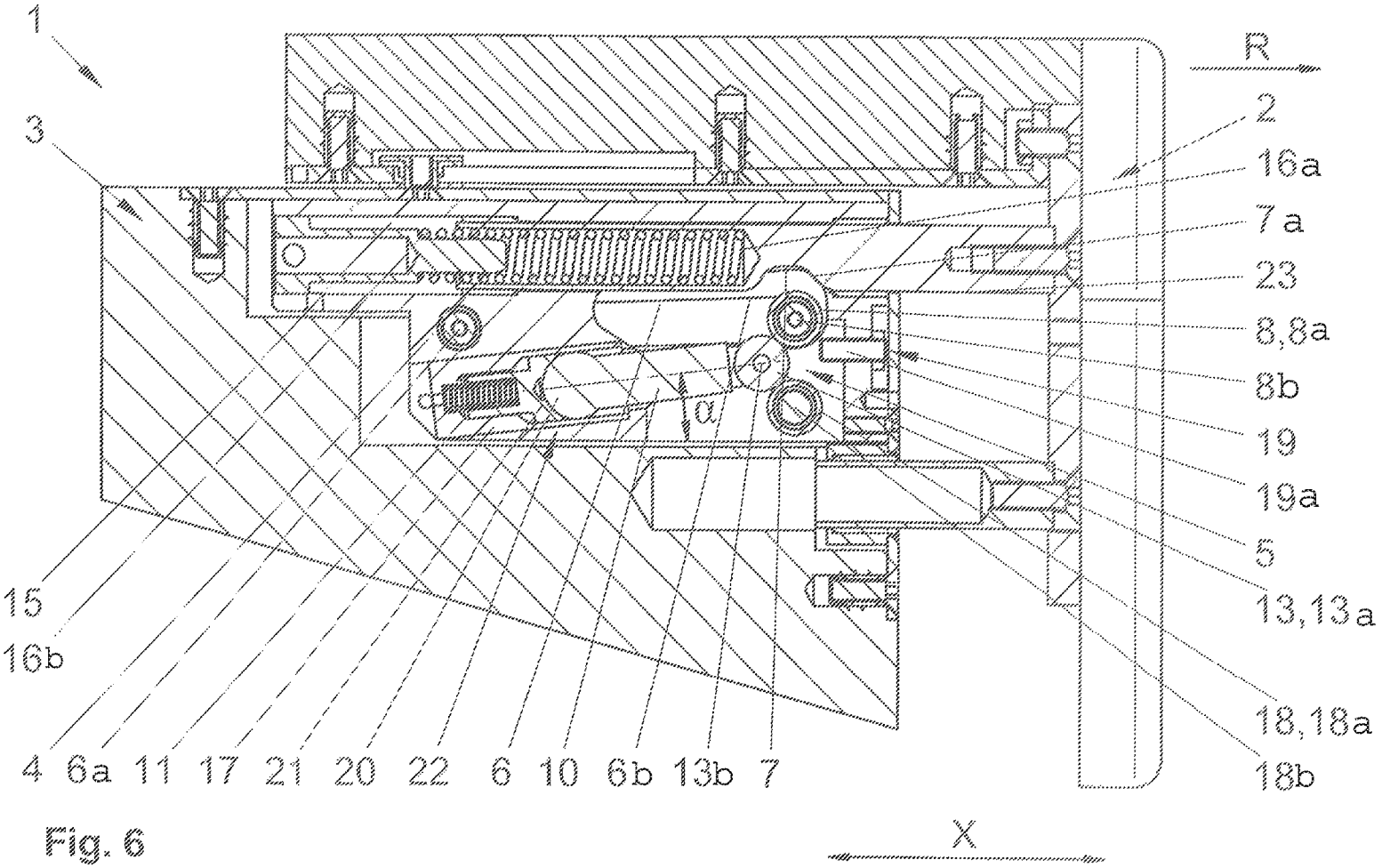
FIG. 6 shows a schematic side view of the second embodiment in a state of transition into a damping process.
Figure 7:
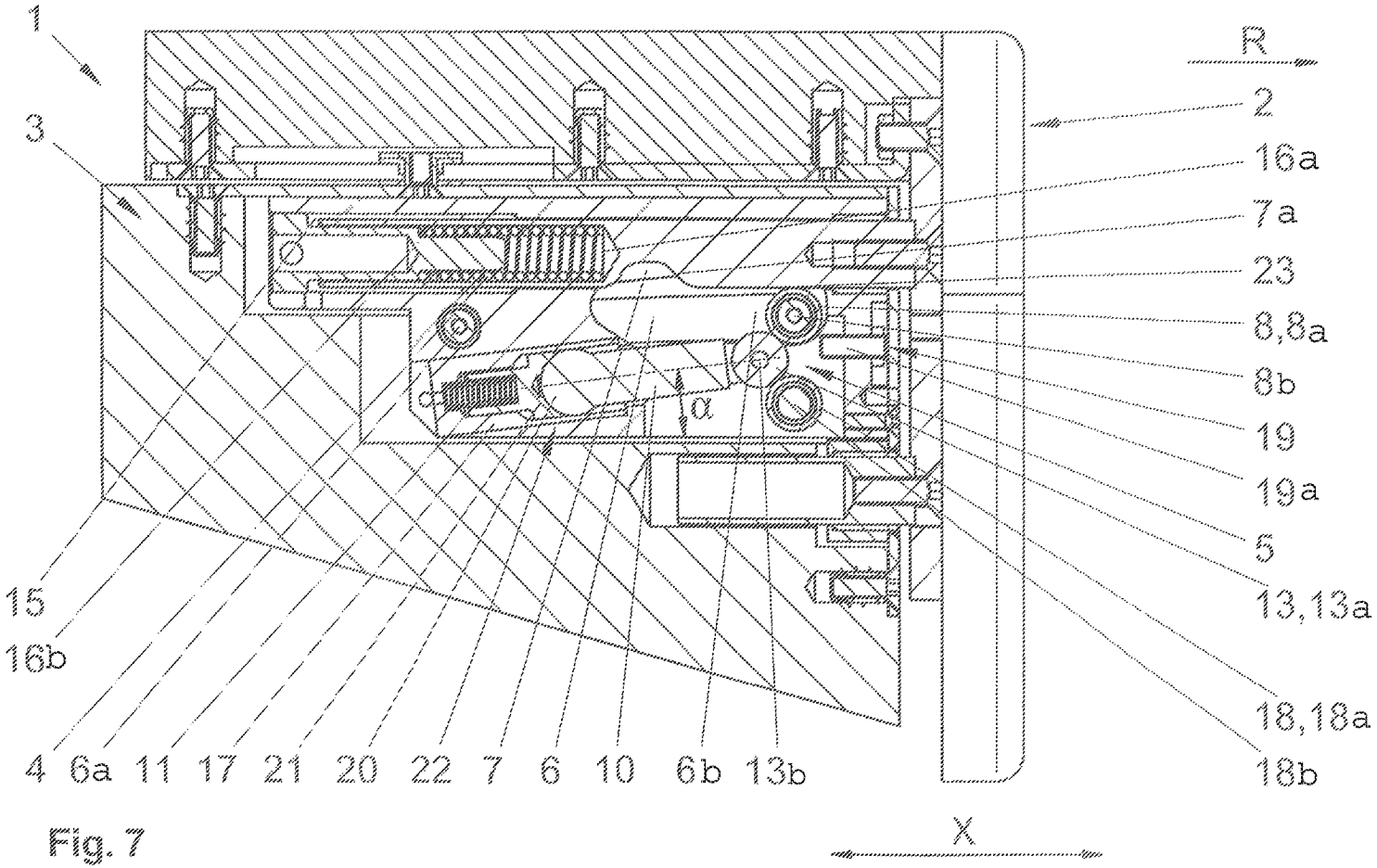
FIG. 7 shows a schematic side view of the second embodiment in a state at the end of the damping process.

FIGS. 5 to 7 relate to a second embodiment of the recoil-damping device 1 which differs only partially from the first embodiment so that the description of the second embodiment substantially concentrates on the differences from the first embodiment. Particularly advantageous with the second embodiment is the comparatively short design which in particular also enables a retrofitting to existing buttstocks. In addition, this embodiment has a smaller number of parts with the result that cost advantages can be achieved in production.

FIG. 5 shows the recoil-damping device 1 in the rest state of the gun. The recoil-damping device 1 has a rear part 2 and a front part 3 which can be moved towards one another against the force of a damping element 4, in particular a helical spring. In addition, a locking device 5 is provided between the rear part 2 and the front part 3 which locking device 5 in the locking position shown in FIG. 5 blocks a relative movement between rear part 2 and front part 3 and in a release position shown in FIG. 7 allows a relative movement between rear part 2 and front part 3. The locking device 5 has a substantially rectilinearly configured pivot arm 6 with a pivot axis 6*a* and a receiving element 7, in particular a recess. The pivot arm 6 is mounted by means of the pivot axis 6*a* on the front part 3 and in the locking position engages in the receiving element 7 formed in or on the rear part 2. For this engagement, on its end 6*b* facing the receiving element 7 the pivot arm 6 has an element 8 which is circular about its axis of rotation 8*b* in the circumferential direction and mounted rotatably, in particular a roller or ball 8*a*. The receiving element 7 has an obliquely running surface or edge 7*a* along which the roller or ball 8*a* of the pivot arm 6 can roll.

In order to be able to release the locking device 5 from the locking position, a triggering element 10 which can be activated by means of a shock pulse is provided which in the holding position shown in FIG. 5 holds the locking device 5 in the locking position and in the active position shown in FIGS. 6 and 7 releases the transition of the locking device 5 into the release position. The triggering element 10 is configured as a delay element which is displaceable at an acute angle $\alpha$ of optionally at most 20°, or optionally at most 10° substantially in the direction X of the relative movement between rear part 2 and front part 3. For a reliable displacement between the holding position and the active position, the triggering element 10 is received in a guide sleeve 17 and pre-tensioned into the holding position by means of a first pre-tensioning element 11. In the locking position of the locking device 5, the triggering element 10 is in engagement with the locking device 5 to form a line contact or point contact in a contact area 12. For this the triggering element 10 has an element 13 which is circular about an axis of rotation 13*b* in the circumferential direction and mounted rotatably, in particular a roller or ball 13*a*, which is opposite the roller or ball 8*a* of the pivot arm 6. In order on the one hand to hold the pivot arm 6 reliably in the locking position, i.e. in engagement with the receiving element 7 by means of the triggering element 10 and on the other hand, in order to be able to smoothly release the engagement between the pivot arm 6 and the receiving element 7, in the holding position of the triggering element 10, the axis of rotation 8*b* of the roller or ball 8*a*, the axis of rotation 13*b* of the roller or ball 13*a* and the axis of rotation 18*b* of an additional rotatably mounted element 18, in particular a roller or a ball 18*a*, are arranged in a line. In order that the triggering element 10 can reliably force the pivot arm 6 into engagement with the receiving element 7, the additional element 18 is in engagement with the rotatably mounted element 13 of the triggering element 10 opposite the contact point 12 between the rotatably mounted elements 8, 13 of the triggering element 10 and of the pivot arm 6. In addition, an adjusting or limiting device 19 with an adjusting screw 19*a* is provided which stops the displacement of the pre-tensioned triggering element 10 at the position of the line arrangement of the axes of rotation 8*b*, 13*b*, 18*b*. Through the positioning of the adjusting screw 19*a*, the position of the roller 13*a* with respect to the roller 8*a* in the locking position can be fixed. As in FIG. 5, here the alignment of the axis of rotation 13*a* with respect to the axes of rotation 8*b* and 18*b* can be selected in such a manner that the axis of rotation 13*a* is not arranged on an imaginary connecting line of the axes of rotation 8*b*, 18*b* but is arranged slightly closer to the front end of the front part 3. This results in a slight shortening of the path between triggering element 10 and pivot arm 6 required for transfer into the release position so that—for a particularly efficient damping of the recoil—a transfer into the release position takes place more rapidly.

For a reliable rolling movement of the roller or ball 13*a* on the rollers or balls 8*a*, 18*a*, see FIGS. 6 and 7, the triggering element 10 additionally is received pivotably with a partially spherical end region 20 in the guide sleeve 17. In particular, the partially spherical end region 20 jointly with a corresponding counter-body 21 forms a gimbal bearing 22 received displaceably in the guide sleeve 17.

FIG. 6 shows the recoil-damping device 1 shown in FIG. 5 during the transition into a damping process as a result of a firing. As a result of the shock pulse in the recoil direction R, caused by the firing, substantially only with the exception of the inert triggering element 10 or the delay element, the entire gun is pushed backwards so that the triggering element 10 is displaced from the holding position into the active position and rolls here on the roller or ball 8*a* of the pivot arm 6 and on the roller or ball 18*a*. As soon as the triggering element 10 is sufficiently displaced in the direction of the front part 3, the engagement between the pivot arm 6 and the receiving element 7 is released and consequently the transfer of the locking device 5 into the release position is released.

FIG. 7 shows the recoil-damping device 1 shown in FIG. 5 in a state at the end of the damping process. After the transition of the locking device 5 into the release position has been released by the triggering element 10, the roller or ball 8*a* of the pivot arm 6 rolls on a surface 23 of the rear part 2 and the front part 3 is moved towards the rear part 2 whereby the damping element 4 is compressed. The damping element 4 then relaxes again whereby the front part 3 moves away from the rear part 2 and the pivot arm 6 enters into engagement with the receiving element 7. In the exemplary embodiment shown in FIGS. 5 to 7 the rollers or balls 8*a*, 13*a*, 18*a* are optionally always in mutual engagement.

As can be seen clearly from FIGS. 5 to 7, the damping element 4 is arranged laterally to the triggering element 10, substantially parallel to the triggering element 10. Unlike the embodiment of FIGS. 1 to 4 in which the damping element 4 and the triggering element 10 are arranged consecutively in the longitudinal direction of the gun, the embodiment of FIGS. 5 to 7 allows a particularly compact design of the recoil-damping device 1. Therefore a recoil-damping device 1 according to the embodiment according to FIGS. 5 to 7 is particularly suitable for fastening to a buttstock and therefore for retrofitting of the gun.

The invention claimed is:

1. A recoil-damping device for a gun, having a rear part and a front part which are movable towards one another against a force of at least one damping element, wherein a locking device acting between the rear part and the front part is provided, which locking device in a locking position blocks a relative movement between the rear part and the front part and in a release position allows the relative movement between the rear part and the front part, wherein a triggering element which is activated by means of a shock pulse is provided, which in a holding position holds the locking device in the locking position and in an active position releases the locking device into the release position, wherein the triggering element and/or at least a part of the locking device is configured to be pivotable relative to the damping element and pivots about a pivot axis to release the locking device from the locking position into the release position as a result of the shock pulse.

2. The device according to claim 1, wherein in the locking position of the locking device, the triggering element, in a contact region, is in engagement with the locking device to form a line contact or point contact.

3. The device according to claim 2, wherein the line contact or point contact is formed by two mutually opposite rotatable mounted elements which are circular about a respective axis of rotation in a circumferential direction.

4. The device according to claim 3, wherein the rotatably mounted elements are rollers and/or balls arranged on the triggering element and/or on the locking device.

5. The device according to claim 4, wherein the locking device comprises a receiving element and a pivot arm, wherein the receiving element is mounted on the front part and the pivot arm is mounted on the rear part or the receiving element is mounted on the rear part and the pivot arm is mounted on the front part, wherein the pivot arm engages in the receiving element in the locking position, and wherein the pivot arm is in engagement with the triggering element in the locking position.

6. The device according to claim 5, wherein the receiving element is a recess in the front part or the rear part, wherein for engagement in the recess, the pivot arm comprises one of the rotatably mounted elements which is provided for the line contact or the point contact with the triggering element on an end of the triggering element facing the receiving element.

7. The device according to claim 6, wherein the triggering element is pre-tensioned into the holding position by means of a first pre-tensioning element, and wherein the pivot arm is pre-tensioned into the locking position by means of a second pre-tensioning element.

8. The device according to claim 6, wherein the triggering element is configured to be pivotable about the pivot axis and has a different mass above and below the pivot axis, and wherein a mass center of gravity of the triggering element is arranged either above or below the pivot axis.

9. The device according to claim 8, wherein the triggering element comprises one of the rotatably mounted elements and the pivot arm comprises another one of the rotatably mounted elements, and wherein in the holding position of the triggering element, the pivot axis of the triggering element and the two axes of rotation of the rotatably mounted elements of the triggering element and the pivot arm are arranged in a line.

10. The device according to claim 7, wherein the triggering element is configured as a delay element displaceably substantially in a direction of the relative movement between the rear part and the front part.

11. The device according to claim 10, wherein the triggering element is received at least with a partially spherical end region in a guide sleeve pivotably and displaceably.

12. The device according to claim 11, wherein the first pre-tensioning element is received in the guide sleeve.

13. The device according to claim 10, wherein the triggering element comprises one of the rotatably mounted elements and the pivot arm comprises another one of the rotatably mounted elements, and wherein the axes of rotation of the rotatably mounted elements of the triggering element and the pivot arm, in the holding position of the triggering element, are arranged in a line with an axis of rotation of an additional rotatably mounted element, which additional element is in engagement with the rotatably mounted element of the triggering element opposite a contact point between the rotatably mounted element of the triggering element and the rotatably mounted element of the pivot arm.

14. The device according to claim 13, wherein a limiting device is provided which stops the displacement of the triggering element pre-tensioned by the first pre-tensioning element at a position of a linear arrangement of the axes of rotation, and wherein the additional rotatably mounted element is a roller or a ball.

15. The device according to claim 1, wherein guide rollers guiding the relative movement between the rear part and the front part are provided.

16. The device according to claim 15, wherein the guide rollers are mounted on the rear part and engage in guide grooves or guide rails in or on the front part, or wherein the guide rollers are mounted on the front part and engage in guide grooves or guide rails in or on the rear part.

17. The device according to claim 1, wherein the rear part or the front part has a longitudinally directed indentation running in a direction of the relative movement between the rear part and the front part, which indentation receives the damping element acting with one end on the rear part and acting with the other end on the front part.

18. The device according to claim 1, wherein the damping element is a spring.

19. The device according to claim 18, wherein the damping element is a helical spring.

20. The device according to claim 1, wherein the recoil-damping device is fastened onto or in a buttstock of the gun, and wherein the gun is a handgun.

* * * * *